US011122902B2

(12) United States Patent
Leng

(10) Patent No.: US 11,122,902 B2
(45) Date of Patent: Sep. 21, 2021

(54) CHAIR AND CHAIR BASE

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 16/924,921

(22) Filed: Jul. 9, 2020

(65) Prior Publication Data

US 2021/0007489 A1 Jan. 14, 2021

(30) Foreign Application Priority Data

Jul. 11, 2019 (CN) ..... 201921084699.9

(51) Int. Cl.

| | |
|---|---|
| ***A47C 4/04*** | (2006.01) |
| ***A47C 4/20*** | (2006.01) |
| ***A47C 7/00*** | (2006.01) |
| ***A47C 4/02*** | (2006.01) |
| ***A47C 4/18*** | (2006.01) |
| *A61G 5/08* | (2006.01) |

(52) U.S. Cl.

CPC ..... *A47C 4/02* (2013.01); *A47C 4/04* (2013.01); *A47C 4/18* (2013.01); *A47C 7/006* (2013.01); *A61G 5/08* (2013.01)

(58) Field of Classification Search

CPC .. A47C 4/02; A47C 4/18; A47C 7/004; A47C 4/20; A47C 9/00; A47C 7/002; A47C 7/006; A47C 4/04; F16M 11/00; A61G 5/08

USPC ..... 297/16.1, 30, 45, 440.22, 461, 445.1, 297/164; 248/166, 168, 171, 173, 435; D6/499

See application file for complete search history.

(56) References Cited

U.S. PATENT DOCUMENTS 471,184 A * 3/1892 Milner ..... A47C 3/24 248/405
582,136 A * 5/1897 Comfort ..... A47C 4/286 297/51
755,043 A * 3/1904 Pike et al. ..... F16M 11/28 248/171

(Continued)

FOREIGN PATENT DOCUMENTS

CN 204048771 U 12/2014
FR 2845877 A1 * 4/2004 ..... A47C 7/004

*Primary Examiner* — Robert Canfield

(74) *Attorney, Agent, or Firm* — Cooper Legal Group, LLC

(57) ABSTRACT

The present disclosure discloses a chair and a chair base. The chair base comprises a connection pipe, four support legs, and two C-shaped swinging rods. The four support legs are respectively disposed along four directions. The two support legs disposed in a left-to-right direction are fixedly connected to the connection pipe, and lower sides of middle portions of the two support legs are respectively disposed with a hinge piece. The two support legs disposed in a front-to-rear direction are rotatably connected to the connection pipe and comprise sliding sleeves. Two ends of the two C-shaped swinging rods are respectively rotatably connected to the hinge pieces of the two support legs disposed in the left-to-right direction. Middle portions of the two C-shaped swinging rods are respectively connected to the sliding sleeves of the two support legs disposed along the front-to-rear direction through link rods.

11 Claims, 5 Drawing Sheets

(56) References Cited

U.S. PATENT DOCUMENTS

| | | | | | |
|---|---|---|---|---|---|
| 1,234,510 | A * | 7/1917 | Trautwein | F16M 11/28 | 248/171 |
| 5,505,524 | A * | 4/1996 | Drumwright | A47C 1/04 | 248/169 |
| 6,030,045 | A * | 2/2000 | Hoshino | A47C 9/08 | 297/461 |
| 6,672,660 | B2 * | 1/2004 | Hoshino | A47C 7/029 | 297/195.1 |
| 7,234,781 | B2 * | 6/2007 | Liao | A47C 3/24 | 248/157 |
| 2002/0195528 | A1 * | 12/2002 | Overbeck | A47C 4/20 | 248/188.6 |
| 2004/0212238 | A1 * | 10/2004 | Chen | A47C 3/20 | 297/344.19 |
| 2017/0007026 | A1 * | 1/2017 | Avery | A47C 4/10 | |
| 2019/0254433 | A1 * | 8/2019 | Smit | A47C 3/18 | |

* cited by examiner

CHAIR AND CHAIR BASE

RELATED APPLICATION

This application claims priority to Chinese Patent Application 201921084699.9, filed on Jul. 11, 2019. Chinese Patent Application 201921084699.9 is incorporated herein by reference.

FIELD OF THE DISCLOSURE

The present disclosure relates to a chair and a chair base, and in particular relates to a folding chair and a chair base with a folding function.

BACKGROUND OF THE DISCLOSURE

Chinese utility model application with a publication number of CN204048771U discloses a chair, which comprises a seat base and a caster foot configured to support the seat base on the ground. The caster foot comprises a hollow pipe configured to be connected to the seat base and a plurality of support legs evenly spaced to surround a peripheral of the hollow pipe. The support legs rest on the ground and cooperate to support the weight of the chair. The plurality of support legs occupy a large area, which is usually larger than the seat base, so as to support the seat base more stably and make the chair stable, so that people can feel more safe when sitting on the chair.

However, since the plurality of support legs are fixedly connected to the hollow pipe, the caster foot does not have an ability to be deformed or folded. When the chair is not used, for example, during storage or transportation, the caster foot occupies a large space, which makes the chair difficult to store or transport and makes the chair less desirable in the market.

BRIEF SUMMARY OF THE DISCLOSURE

The present disclosure provides a chair and a chair base thereof, which overcome the deficiencies of existing techniques. In order to solve the aforementioned technical problems, a technical solution of the present disclosure is as follows.

A chair base comprises a connection pipe vertically disposed, four support legs surrounding a peripheral of the connection pipe, and two C-shaped swinging rods. The four support legs are respectively disposed along a front direction, a rear direction, a left direction, and a right direction. The four support legs cooperate to support the connection pipe. The two support legs respectively disposed along the left direction and the right direction are fixedly connected to the connection pipe, and lower sides of middle portions of the two support legs respectively disposed along the left direction and the right direction are each disposed with a hinge piece. The two support legs respectively disposed along the front direction and the rear direction are rotatably connected to the connection pipe and comprise sliding sleeves. The two C-shaped swinging rods are configured to cooperate to define a ring surrounding the connection pipe. Two ends of the two C-shaped swinging rods are respectively rotatably connected to the hinge pieces of the two support legs respectively disposed along the left direction and the right direction. Middle portions of the two C-shaped swinging rods are respectively connected to the sliding sleeves of the two support legs respectively disposed along the front direction and the rear direction through link rods.

The two C-shaped swinging rods are configure to respectively drive the two support legs respectively disposed along the front direction and the rear direction to be turned down so as to be folded.

Compared with existing techniques, the technical solution of the present disclosure has the following advantages.

The two C-shaped swinging rods are pivotally (i.e., rotatably) connected to the two support legs respectively disposed along the left direction and the right direction and are configured to rotate downward to be folded downward. The two support legs respectively disposed along the front direction and the rear direction are rotatably connected to the connection pipe. Therefore, when the two C-shaped swinging rods rotate downward to be folded downward, the link rods pull the sliding sleeves to slide on the two support legs respectively disposed along the front direction and the rear direction to enable the two support legs respectively disposed along the front direction and the rear direction to rotate downward to achieve folding. Therefore, a size of the chair base in a front-to-rear direction is reduced. In this way, the chair base has a flat structure after the two support legs respectively disposed along the front direction and the rear direction are folded, and an occupied space can be greatly reduced.

BRIEF DESCRIPTION OF THE DRAWINGS

The present disclosure will be further described below with reference to the drawings and embodiments.

DETAILED DESCRIPTION OF THE EMBODIMENTS

Figure 1:
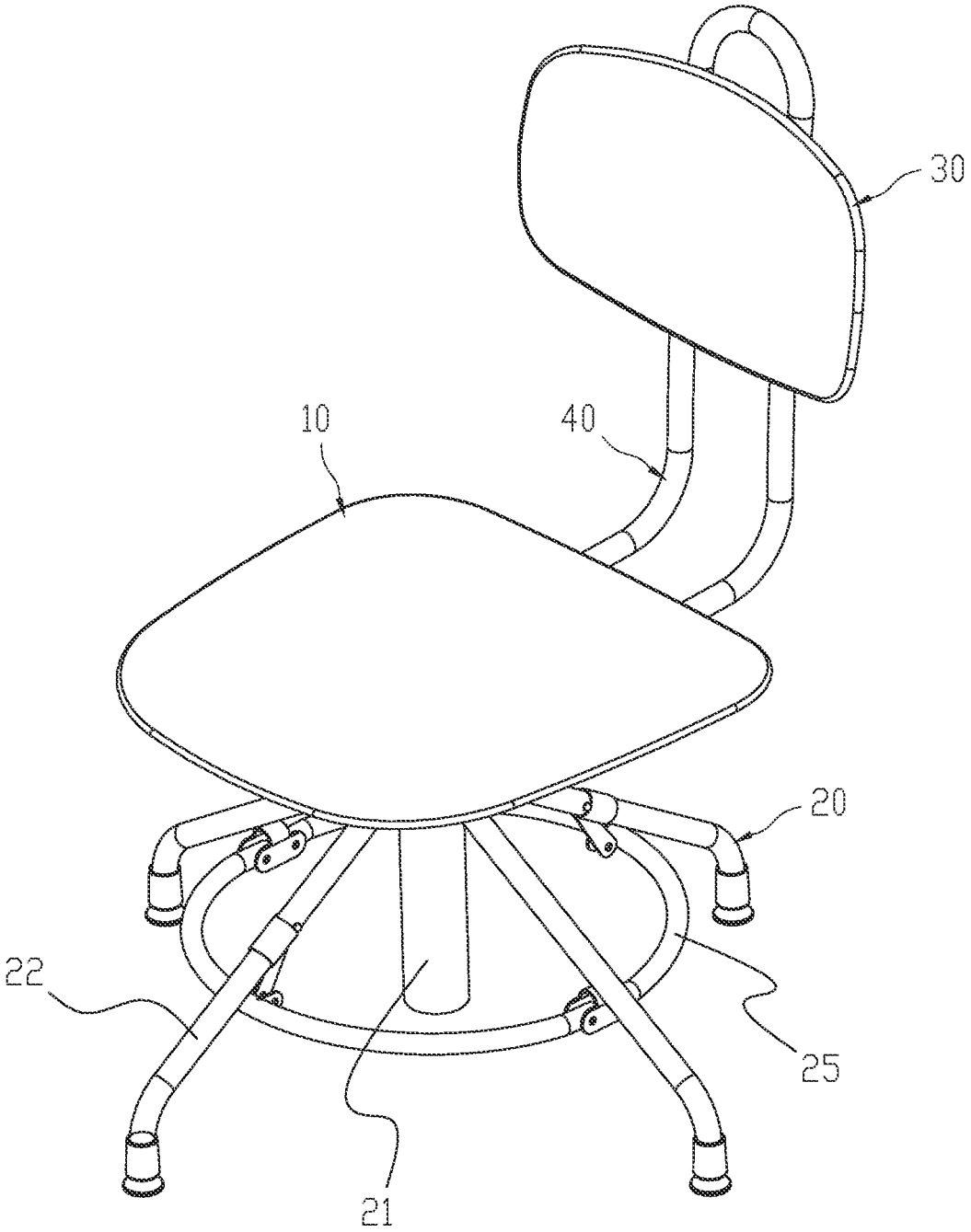
FIG. 1 is a perspective view of a chair of the present disclosure.
Figure 2:
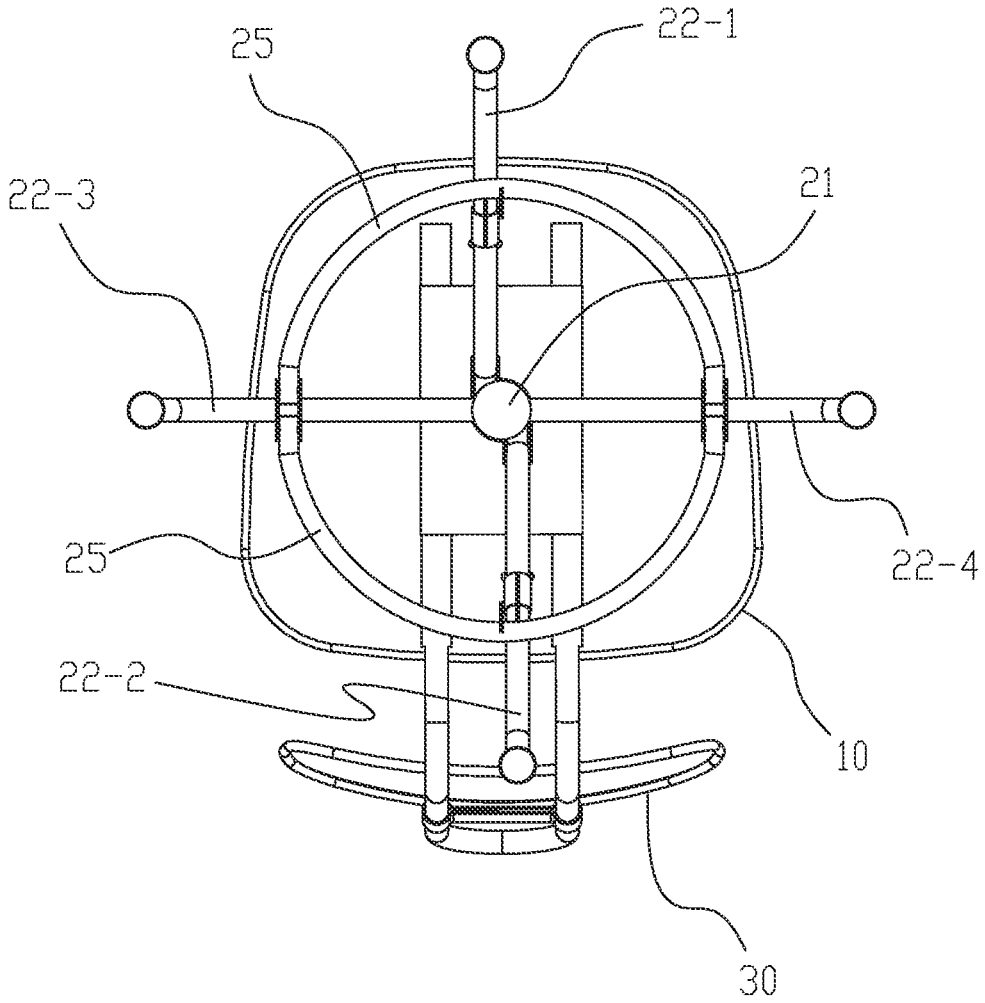
FIG. 2 is a bottom view of the chair of FIG. 1.
Figure 3:
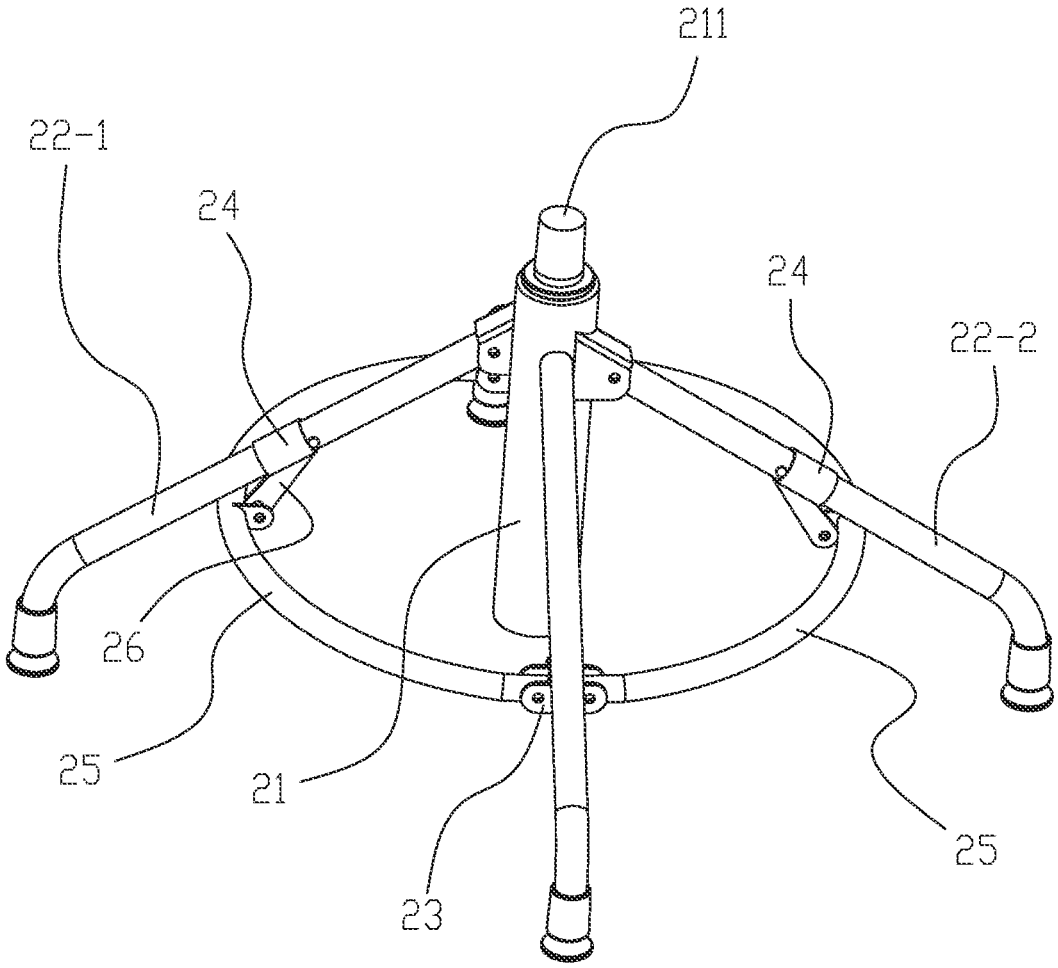
FIG. 3 is a perspective view of a chair base of the chair of FIG. 1.

Referring to FIGS. 1-5, a chair of the present disclosure comprises a cushion 10, a chair base 20, a backrest 30, and a bracket 40. The chair base 20 supports the cushion 10, and the bracket 40 is connected to the backrest 30 and the cushion 10.

The chair base 20 comprises a connection pipe 21 vertically disposed and four support legs 22 surrounding a peripheral of the connection pipe 21. The four support legs 22 are respectively disposed along (i.e., extend in) four directions: a front direction, a rear direction, a left direction, and a right direction. The four support legs 22 cooperate to support the connection pipe 21 to enable the connection pipe 21 to be suspended above the ground. In order to be described in a simple way, the four support legs 22 disposed along the front direction, the rear direction, the left direction, and the right direction are referenced with four numbers 22-1, 22-2, 22-3, and 22-4.

Figure 4:
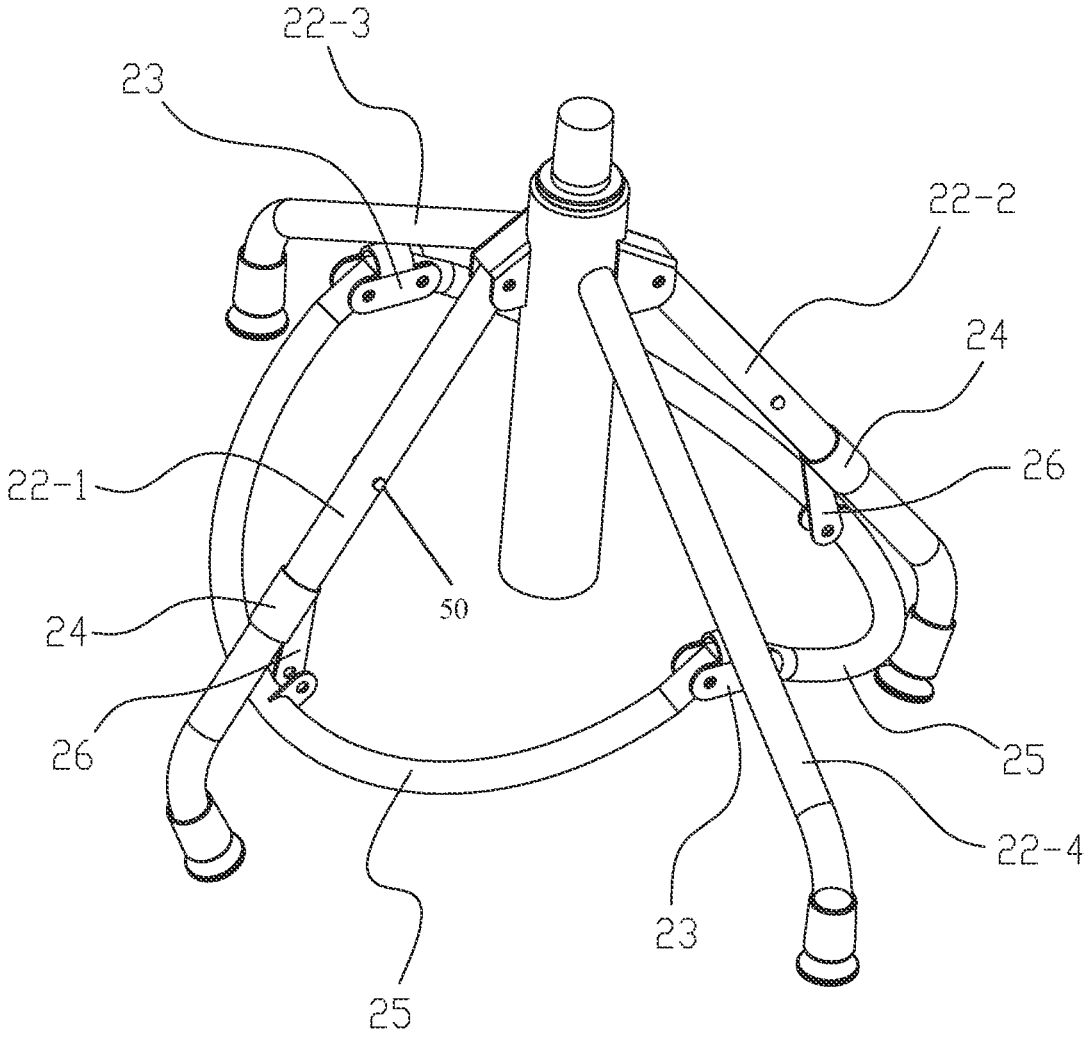
FIG. 4 is a perspective view when two C-shaped swinging rods of the chair base of FIG. 3 are turned downward.
Figure 5:
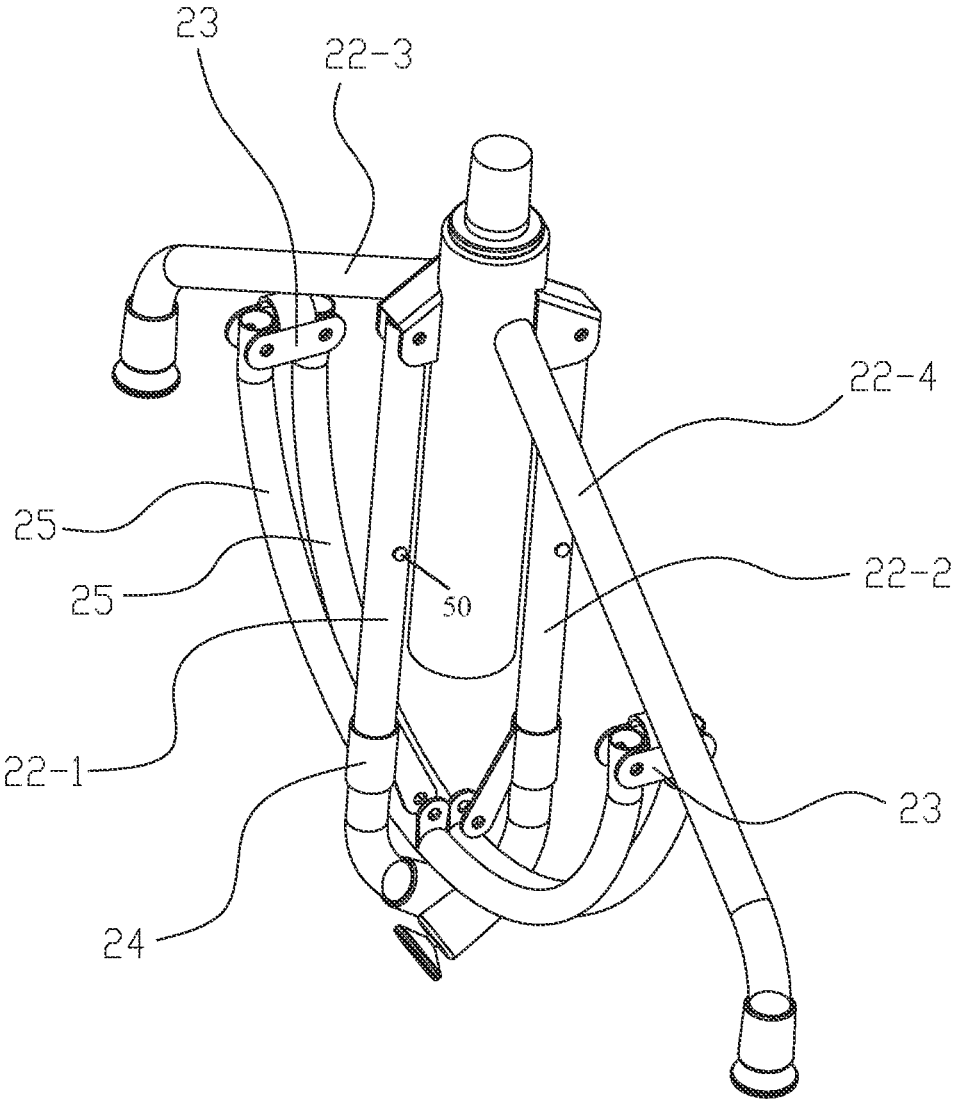
FIG. 5 is a perspective view when the chair base of FIG. 3 is folded.

The two support legs 22-3 and 22-4 respectively disposed along the left direction and the right direction are fixedly connected to the connection pipe 21, and lower sides of middle portions of the two support legs 22-3 and 22-4 are respectively disposed with a hinge piece 23. The two support legs 22-1 and 22-2 respectively disposed along the front direction and the rear direction are rotatably connected to the connection pipe 21 and comprise sliding sleeves 24. The sliding sleeves 24 are configured to slide on the two support legs 22-1 and 22-2. The chair base 20 further comprises two C-shaped swinging rods 25. The two C-shaped swinging rods 25 are symmetrically disposed. When the two C-shaped swinging rods 25 are unfolded, the two C-shaped swinging rods 25 cooperate to define a ring surrounding the connection pipe 21. Two ends of the two C-shaped swinging rods 25 are respectively rotatably connected to the hinge pieces 23 of the two support legs 22-3 and 22-4 respectively disposed along the left direction and the right direction, so that the two C-shaped swinging rods 25 can be turned downward to be folded. Middle portions of the two C-shaped swinging rods 25 are respectively connected to the sliding sleeves 24 of the two support legs 22-1 and 22-2 respectively disposed along the front direction and the rear direction through two link rods 26. Referring to FIGS. 4 and 5, the two C-shaped swinging rods 25 are configure to respectively drive the two support legs 22-1 and 22-2 respectively disposed along the front direction and the rear direction to be turned down so as to be folded.

The two support legs 22-1 and 22-2 respectively disposed along the front direction and the rear direction each comprises a positioning pin 50. When the two support legs 22-1 and 22-2 respectively disposed along the front direction and the rear direction are unfolded, the sliding sleeves 24 move to positions of the positioning pins 50 and are engaged with the positioning pins 50 to prevent the two C-shaped swinging rods 25 from being folded due to operated incorrectly. When the two C-shaped swinging rods 25 need to be folded, the positioning pins 50 are first separated from the sliding sleeves 24 by a force, and then the two C-shaped swinging rods 25 are turned downward.

The two support legs 22-1 and 22-2 respectively disposed along the front direction and the rear direction are staggered and are disposed on two sides of the connection pipe 21. When being folded, the two support legs 22-1 and 22-2 respectively disposed along the front direction and the rear direction each abuts the connection pipe 21 to enable the two support legs 22-1 and 22-2 respectively disposed along the front direction and the rear direction to be folded in a maximum extent.

In some embodiments, an extendable rod 211 is disposed in the connection pipe 21, and an upper end of the extendable rod 211 upwardly protrudes out of the connection pipe 21. The extendable rod 211 is configured to extend and contract to drive the cushion 10 to move upward and downward so as to adjust a height of the chair.

In some embodiments, lower ends of the four support legs 22 comprise casters to facilitate a movement of the chair.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

What is claimed is:

1. A chair base, comprising:

a connection pipe vertically disposed, four support legs surrounding a peripheral of the connection pipe, and two C-shaped swinging rods, wherein:

the four support legs are respectively disposed along a front direction, a rear direction, a left direction, and a right direction, the four support legs cooperate to support the connection pipe, the two support legs respectively disposed along the left direction and the right direction are fixedly connected to the connection pipe, lower sides of middle portions of the two support legs respectively disposed along the left direction and the right direction are each disposed with a hinge piece, the two support legs respectively disposed along the front direction and the rear direction are rotatably connected to the connection pipe and comprise sliding sleeves, the two C-shaped swinging rods are configured to cooperate to define a ring surrounding the connection pipe, two ends of the two C-shaped swinging rods are respectively rotatably connected to the hinge pieces of the two support legs respectively disposed along the left direction and the right direction, middle portions of the two C-shaped swinging rods are respectively connected to the sliding sleeves of the two support legs respectively disposed along the front direction and the rear direction through link rods, and the two C-shaped swinging rods are configure to respectively drive the two support legs respectively disposed along the front direction and the rear direction to be turned down so as to be folded.

2. The chair base according to claim 1, wherein:

the two support legs respectively disposed along the front direction and the rear direction each comprises a positioning pin, and when the two support legs respectively disposed along the front direction and the rear direction are unfolded, the sliding sleeves move to positions of the positioning pins and are engaged with the positioning pins.

3. The chair base according to claim 2, wherein:

the two support legs respectively disposed along the front direction and the rear direction are staggered and are disposed on two sides of the connection pipe, and when the two support legs respectively disposed along the front direction and the rear direction are folded, the two support legs respectively disposed along the front direction and the rear direction each abuts the connection pipe.

4. A chair, comprising:

a cushion, and a chair base according to claim 3, wherein the chair base supports the cushion.

5. A chair, comprising:

a cushion, and a chair base according to claim 2, wherein the chair base supports the cushion.

6. The chair base according to claim 1, wherein:

the two support legs respectively disposed along the front direction and the rear direction are staggered and are disposed on two sides of the connection pipe, and when the two support legs respectively disposed along the front direction and the rear direction are folded, the two support legs respectively disposed along the front direction and the rear direction each abuts the connection pipe.

7. A chair, comprising:

a cushion, and a chair base according to claim 6, wherein the chair base supports the cushion.

8. The chair base according to claim 1, wherein:

an extendable rod is disposed in the connection pipe, and an upper end of the extendable rod upwardly protrudes out of the connection pipe.

9. A chair, comprising:

a cushion, and a chair base according to claim 8, wherein the chair base supports the cushion.

10. A chair, comprising:

a cushion, and a chair base according to claim 1, wherein the chair base supports the cushion.

11. The chair according to claim 10, wherein the chair further comprises a backrest and a bracket connected to the backrest and the cushion.

* * * * *